United States Patent [19]

Jones

[11] Patent Number: 4,776,776

[45] Date of Patent: Oct. 11, 1988

[54] SMALL PUMP VALVE PLATE ASSEMBLY

[75] Inventor: David T. Jones, Bridgeville, Pa.

[73] Assignee: The DeVilbiss Company, Toledo, Ohio

[21] Appl. No.: 88,784

[22] Filed: Aug. 24, 1987

[51] Int. Cl.[4] ..... F04B 21/02

[52] U.S. Cl. ..... 417/560; 417/566; 417/571; 137/512.4

[58] Field of Search ..... 417/560, 566, 569, 570, 417/571, 559; 137/512.4

[56] References Cited

U.S. PATENT DOCUMENTS

| | | | |
|---|---|---|---|
| 1,633,772 | 6/1927 | Clapp . | |
| 2,875,776 | 3/1959 | Skipwith, Jr. | 137/512.4 X |
| 3,314,600 | 4/1967 | Hadley | 417/571 X |
| 3,360,169 | 12/1967 | Susuki et al. . | |
| 3,547,561 | 12/1970 | Lavon . | |
| 4,259,951 | 4/1981 | Chernack et al. . | |
| 4,437,490 | 3/1984 | Demers et al. . | |
| 4,573,888 | 3/1986 | Kitchin . | |

FOREIGN PATENT DOCUMENTS

| | | | |
|---|---|---|---|
| 53-084211 | 7/1978 | Japan | 417/571 |
| 57-052691 | 3/1982 | Japan | 417/571 |

*Primary Examiner*—Carlton R. Croyle
*Assistant Examiner*—Eugene L. Szczecina, Jr.
*Attorney, Agent, or Firm*—MacMillan, Sobanski & Todd

[57] ABSTRACT

An improved valve plate assembly for use with a reciprocating piston fluid pump such as a low capacity air compressor. A resilient rubber valve molding is positioned over a plate defining inlet and outlet ports for forming a seal between the plate and a cylinder head, for forming an inlet check valve and for forming an outlet check valve.

5 Claims, 2 Drawing Sheets

SMALL PUMP VALVE PLATE ASSEMBLY

TECHNICAL FIELD

The invention relates to fluid pumps and more particularly to a valve plate assembly containing inlet and outlet check valves for use in small reciprocating piston pumps such as small air compressors used for medical purposes.

BACKGROUND ART

For relative low pressure, low capacity reciprocating piston compressors, a valve plate containing inlet and outlet ports is clamped between a cylinder and a cylinder head. Valves reeds are riveted or otherwise attached to opposite sides of the valve plate to form check valves which allow air to flow through the inlet port into the cylinder during the intake or suction stroke of the piston and to to flow through the outlet port during the compression stroke.

Problems are often encountered during manufacture of compressors having reed valves. The prior art valve plate assemblies are relative expensive to manufacture and tend to leak, which as a consequence reduces the output from the compressor. The metal valve reeds are subject to bending during assembly handling. Therefore, it is necessary to test each compressor after it is assembled and it often is necessary to partially dismantle a newly manufactured compressor to replace a faulty valve plate assembly. Also, the valve reeds may bend during normal use and the valve reeds tend to be noisy during operation.

The prior art also discloses valve plate assemblies in which a flat resilient member is clamped over ports. Circular or somewhat parabolic shaped flaps are cut in the resilient member to form valves attached to the member by resilient hinges. The valves are positioned to cover the ports. This arrangement eliminates some of the problems with reed valves. However, closing of the valve flaps is limited by the limited force exerted by the resilient hinge. Also, additional components, such as a second rigid plate, are required to form both intake and exhaust valves.

DISCLOSURE OF INVENTION

The invention is directed to an improved valve plate assembly for use in small reciprocating piston fluid pumps such as low capacity air compressors. The assembly has a valve plate similar to the prior art valve plate having openings which define inlet and outlet ports. A rubber valve molding is wrapped around the edge of the valve plate to form a seal between the valve plate and a cylinder head. The valve molding has an integral first flap which covers the inlet port opening only on the cylinder side of the valve plate to form an intake check valve and has an integral second flap which covers the outlet port opening only on the cylinder head side of the valve plate to form an outlet check valve. Because of the natural elasticity of the rubber in the valve molding, the valves will be normally closed, but will open with a minimal pressure drop. By eliminating the metal to metal contact of the prior art valve reeds, the noise level of the compressor is reduced substantially. The rubber valve molding both replaces the valve reeds and replaces a separate rubber gasket normally used to seal input/output chambers in the cylinder head adjacent the valve plate. The labor required for assembling the valve plate is greatly reduced with the reduction of parts and the simpler assembly. Also, the efficiency of the compressor is improved.

Accordingly, it is an object of the invention to provide an improved valve plate assembly for use in small reciprocating piston fluid pumps such as small air compressors.

Other objects and advantages of the invention will be apparent from the following detailed description and the drawings.

BEST MODE FOR CARRYING OUT THE INVENTION

Figure 1:
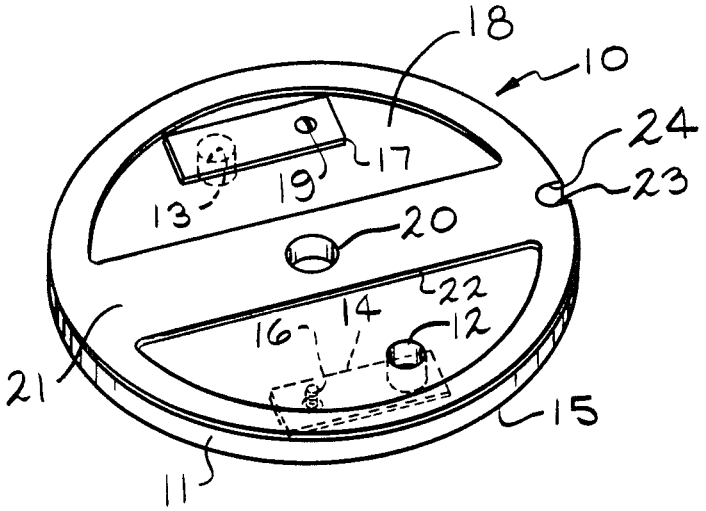
FIG. 1 PRIOR ART
FIG. 1 is a perspective view of a prior art valve plate assembly for use in a small reciprocating piston fluid pump.

Referring to the drawings and particularly to FIG. 1, an exemplary prior art valve plate assembly 10 of a type sometimes used in a small reciprocating piston compressor (not shown) is illustrated. The valve plate assembly 10 is designed to be attached to a cylinder head above a piston. The assembly 10 generally includes a flat circular metal plate 11 which defines an inlet port 12 and an outlet port 13. A flat metal valve reed 14 is attached to a bottom surface 15 of the plate 11 with a rivet or screw 16 and is located to cover the inlet port 12. A second flat metal valve reed 17 is attached to a top surface 18 of the plate 11 with a rivet or screw 19 to cover the outlet port 13.

The valve plate assembly 10 is attached to a compressor cylinder head (not shown) by means of a screw (not shown) passed through a central opening 20 in the plate 11. A flat gasket 21 extends around the periphery of the top surface 18 for sealing the plate 11 to the compressor cylinder head. The gasket 21 includes a diagonal web 22 which also seals to the cylinder head to separate an intake chamber located in the cylinder head above the inlet port 12 from an outlet chamber located in the cylinder head above the outlet port 13. Finally, the valve plate 11 and the gasket 21 have locating notches 23 and 24, respectively, for properly positioning the gasket 21 on the valve plate 11 and for positioning the assembly 10 relative to the cylinder head.

In operation, the valve reed 14 deflects to allow air to pass through the inlet port 12 and into the cylinder during the intake or suction stroke of the piston. When movement of the piston stops, the valve reed 14 moves through its resilience to close the port 12. During the compression stroke, air pressure in the cylinder deflects the valve reed 17 to allow compressed air to flow through the outlet port 13. At the end of the compression stroke, the valve reed 17 moves back to its normal position closing the port 13. Each time one of the valve reeds 14 or 17 closes, the metal to metal contact makes a noise. The metal valve reeds 14 and 17 also are subject to fatigue and bending after extended operation and may not seal well against the valve plate 11, thereby reducing the efficiency of the compressor.

Figure 3:
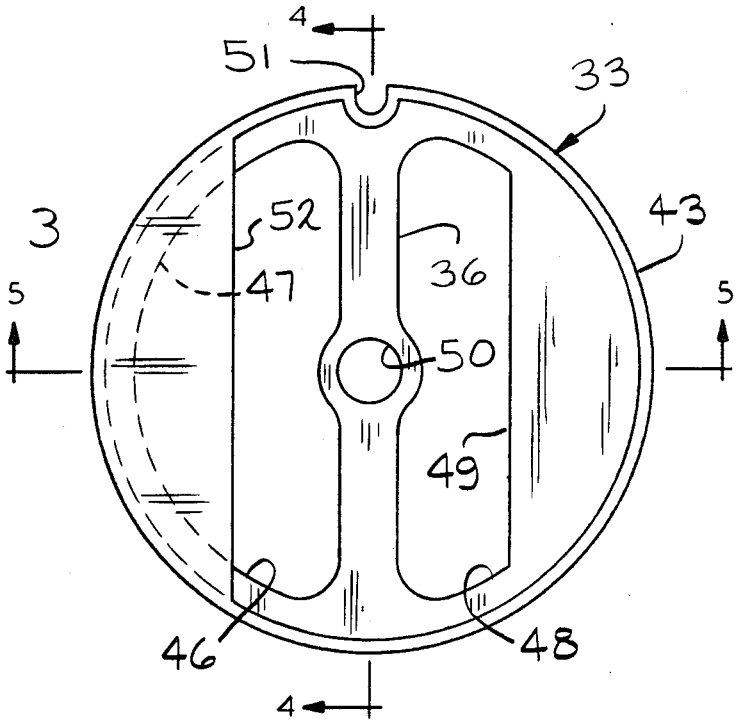
FIG. 3 is a bottom plan view of a rubber valve molding for use in a valve plate assembly according to the invention.
Figure 2:
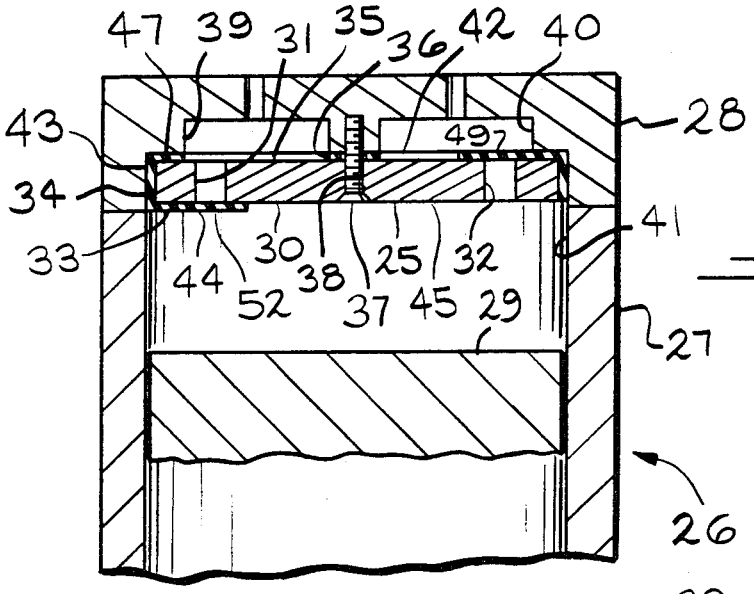
FIG. 2 is a fragmentary cross sectional view through a reciprocating piston air compressor showing a cylinder, a cylinder head, a piston and the valve plate assembly of the invention.

Turning now to FIGS. 2-5, an improved valve plate assembly 25 is shown according to the invention. In FIG. 2, a fragmentary portion of a compressor 26 is shown incorporating the valve plate assembly 25. The illustrated portion of the compressor 26 includes a cylinder 27, a cylinder head 28 and a reciprocating piston 29. The valve plate assembly 25 includes a circular valve plate 30 which defines an inlet port 31 and an outlet port 32. A rubber valve molding 33 is partially wrapped around an outer edge 34 of the plate 30 and extends around the periphery of a top surface 35 of the plate 30. As best seen in FIGS. 2 and 3, the valve molding 33 has a web 36 which extends across a diameter of the molding 33.

The valve plate assembly 25 is attached to the cylinder head 28 by means of a screw 37 passing through a central opening 38 in the valve plate 30. When the valve plate assembly 30 is attached to the cylinder head 28, the valve molding 33 forms a seal between the plate 30 and the cylinder head 28 to isolate an intake chamber 39, an outlet chamber 40 and a compression chamber 41 below the plate 30.

The valve plate 30 is substantially identical to the prior art valve plate 11, except that rivet or screw holes are not required with the elimination of the valve reeds 14 and 17. Also, with the elimination of the valve reeds, the plate 30 may be manufactured from a less expensive material, such as a synthetic resin.

Figure 4:
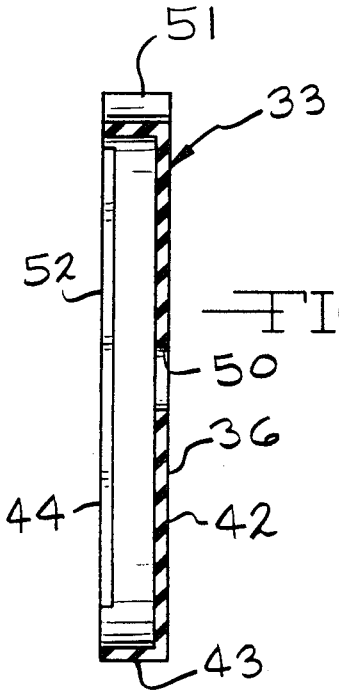
FIG. 4 is a cross sectional view along line 4—4 of FIG. 3.
Figure 5:
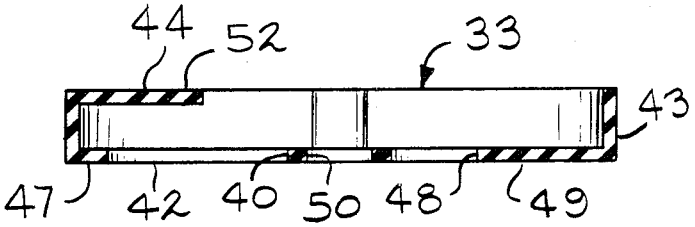
FIG. 5 is a cross sectional view along line 5—5 of FIG. 3.

Details of the rubber valve molding 33 are shown in FIGS. 3-5. The valve molding 33 has a generally flat upper surface 42 which engages the top surface 35 of the plate 30, a cylindrical outer edge 43 which engages the plate edge 34, and a flat lower surface 44 which engages a lower surface 45 on the plate 30 (see FIG. 2). The upper surface 42 defines a semicircular opening 46 between the central web 36 and an annular portion 47 adjacent the outer edge 43. A second opening 48 on the opposite side of the web 36 extends to an outlet valve flap 49. The web 36 has a central opening 50 through which the screw 37 passes. A locating notch 51 is formed in the outer edge 43 adjacent one end of the web 36 for engaging a corresponding locating notch (not shown) in the plate 30. On the lower surface 44 of the valve molding 33, a semicircular inlet valve flap 52 extends from the outer edge 43 opposite a portion of the opening 46 for engaging the lower plate surface 45. When the valve molding 33 is positioned on the valve plate 30, the inlet valve flap 52 covers the inlet port 31 and the outlet valve flat 49 covers the outlet port 32, as shown in FIG. 2.

From viewing the drawings, it will be noted that both of the valve flaps 49 and 52 are semicircular in shape and are retained along their curved edge. As a consequence, whenever either valve flap opens, the resilient material firming such flap is stretched and in tension. The tension in the valve flap significantly increases the force tending to close the valve over that present in a generally similar valve having only a hinged edge. The shape of the valve flaps and the tension tending to close the valve flaps permits the use of larger valve ports to increase the pump's efficiency and also permits use of noncircular shapes for the valve ports, such as a semicircular shape.

Figure 6:
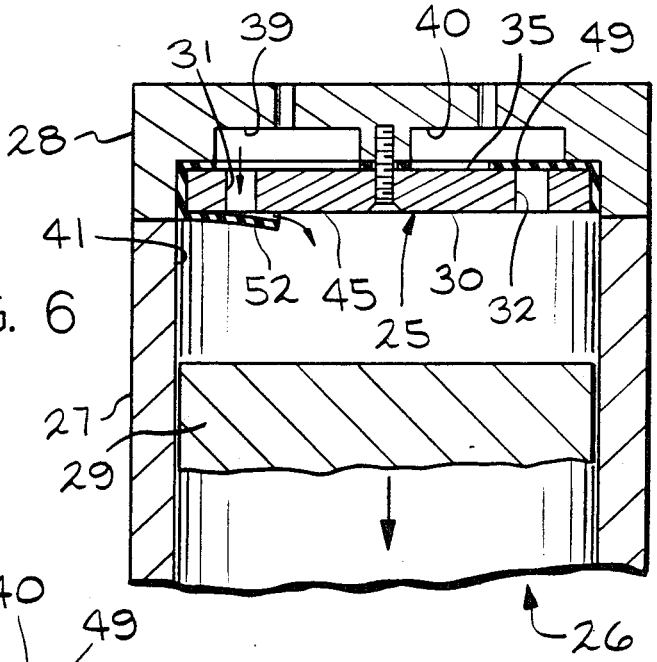
FIG. 6 is a fragmentary cross sectional view similar to FIG. 2, but showing the piston moving downwardly and the intake valve open.
Figure 7:
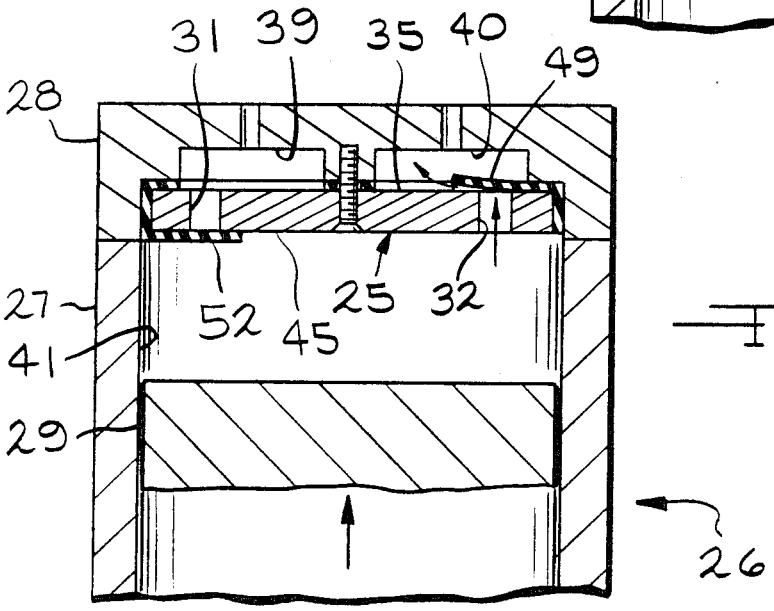
FIG. 7 is a fragmentary cross sectional view similar to FIG. 2, but showing the piston moving upwardly and the outlet valve open.

Operation of the compressor 26 is illustrated in FIGS. 6 and 7. In FIG. 6, the piston 29 is moving downwardly away from the valve plate assembly 25 on an intake stroke. Suction within the cylinder 41 causes the inlet valve flat 52 to move away from the valve plate surface 45 and air is drawn from the inlet chamber 39 through the inlet port 31 and into the cylinder 41. Preferably, the valve molding 33 is formed from a resilient rubber and very little pressure drop occurs as air is drawn past the inlet valve flap 52. During the intake stroke, compressed air in the outlet chamber 40 and the resiliency of the valve flap 49 maintain a fluid tight seal between the outlet valve flap 49 and the top surface 35 on the plate 30 to prevent leakage through the outlet port 32. At the end of the intake stroke, the valve flap 52 is urged against the lower plate surface 45 to again seal the inlet port 31.

During the compression stroke of the piston 29, as shown in FIG. 7, the compressed air in the cylinder 41 moves the outlet valve flap 49 from the upper plate surface 35 and compressed air flows from the chamber 41 through the outlet port 32 into the outlet chamber 40. During the compression stroke, the air pressure and the resiliency of the valve flap 52 maintain a fluid tight seal between the inlet valve flap 52 and the lower plate surface 45 to prevent leakage through the inlet port 31.

The valve plate assembly 25 has many advantages over the prior art valve plate assembly 10. The manufacturing costs are significantly reduced since fewer parts and fewer assembly steps are required. Also, the plate 30 may be manufactured from less expensive materials than the plate 11. Operating noise is significantly reduced since metal to metal contact between the valve reeds 14 and 17 and the plate 11 is replaced with rubber to metal contact between the valve flaps 49 and 52 and the plate 30. The prior art metal valve reeds 14 and 17 are subject to leakage. Leakage problems have not occurred in tests of the valve molding 33. Without leakage, the efficiency of the compressor is improved.

Although the valve plate assembly 25 has been described as operating in a compressor, it will be appreciated that it will function equally effective when operated in other types of fluid pumps, such as a suction or vacuum pump. Various changes and modifications may be made to the valve plate assembly without departing from the spirit and the scope of the following claims.

I claim:

1. An improved valve plate assembly for a small fluid pump comprising a generally flat plate having first and second surfaces and an edge extending between said surfaces, said plate defining first and second ports extending between said surfaces, and a resilient valve molding including an outer edge surrounding said plate edge, a first valve flap extending from said outer edge along a portion of said first surface and covering said first port and a second valve flap extending from said outer edge along a portion of said second surface and covering said second port.

2. An improved valve plate assembly, as set forth in claim 1, wherein said plate edge is generally circular, wherein said first and second valve flaps are semicircular with each having a semicircular edge, and wherein each of said first and second valve flaps are attached to said outer edge along the semicircular edge.

3. An improved valve plate assembly, as set forth in claim 2, wherein each of said first and second valve flaps is in tension when separated from the adjacent plate surface to allow fluid passage through the adjacent port.

4. An improved valve plate assembly, as set forth in claim 2, wherein said valve molding has an annular gasket surface extending from said outer edge around the perimeter of said first plate surface.

5. An improved valve plate assembly, as set forth in claim 4, wherein an integral web extends diametrically across said valve molding, whereby, when said valve plate assembly is mounted in the pump, said web forms a gasket separating fluid chambers adjacent said first plate side which separately communicate with said first and second ports

* * * * *

UNITED STATES PATENT AND TRADEMARK OFFICE

CERTIFICATE OF CORRECTION

PATENT NO. : 4,776,776

DATED : October 11, 1988

INVENTOR(S) : David T. Jones

It is certified that error appears in the above-identified patent and that said Letters Patent is hereby corrected as shown below:

On cover page of patent, change the assignee from "The DeVilbiss Company, Toledo, Ohio" to -- DeVilbiss Health Care, Inc., Somerset, Pennsylvania --.

Signed and Sealed this

Twenty-first Day of March, 1989

*Attest:*

DONALD J. QUIGG

*Attesting Officer*

*Commissioner of Patents and Trademarks*